US008317179B2

(12) United States Patent
Takata

(10) Patent No.: US 8,317,179 B2
(45) Date of Patent: Nov. 27, 2012

(54) SHEET POST-PROCESSING DEVICE WITH PERFORATOR AND METHOD FOR MAKING A FOLDED SET OF SHEETS

(75) Inventor: Motoki Takata, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 283 days.

(21) Appl. No.: 12/816,428

(22) Filed: Jun. 16, 2010

(65) Prior Publication Data

US 2010/0320673 A1 Dec. 23, 2010

(30) Foreign Application Priority Data

Jun. 19, 2009 (JP) ..... 2009-146183

(51) Int. Cl.
*B65H 37/06* (2006.01)

(52) U.S. Cl. ..... 270/37; 270/32; 270/30.08; 493/445

(58) Field of Classification Search ..... 270/5.02, 270/20.1, 30.08, 32, 37, 52.17, 52.09; 493/444, 493/445

See application file for complete search history.

(56) References Cited

U.S. PATENT DOCUMENTS 4,338,085 A * 7/1982 Sullivan et al. ..... 493/254
5,405,127 A * 4/1995 Welborn ..... 270/21.1
6,896,250 B2 * 5/2005 Hillebrand ..... 270/52.09
7,523,593 B2 * 4/2009 Aoyagi et al. ..... 53/117
7,740,238 B2 * 6/2010 Iijima et al. ..... 270/37
2006/0279035 A1 * 12/2006 Aoyagi et al. ..... 270/32
2008/0211159 A1 * 9/2008 Iijima et al. ..... 270/37

FOREIGN PATENT DOCUMENTS

JP 2004-284750 A 10/2004
JP 2008-036838 2/2008
JP 2008-214104 A 9/2008

OTHER PUBLICATIONS

Office Action (Notification of Reasons for Refusal) dated May 10, 2011, issued in the corresponding Japanese Patent Application No. 2009-146183, and an English Translation thereof.

* cited by examiner

*Primary Examiner* — Patrick Mackey
(74) *Attorney, Agent, or Firm* — Buchanan Ingersoll & Rooney PC

(57) ABSTRACT

A sheet post-processing device includes a stacker for stacking and storing sheets therein, a feeder for receiving sheets and feeding the sheets toward the stacker, a folder for folding a set of sheets stored in the stacker, a preparatory processor, which is located upstream from the folder, for processing sheets preparatory to folding of a set of sheets, a presser for pressing the set of sheets stored in the stacker at a portion processed by the preparatory processor so as to push the set of sheets into the folder, and a controller for controlling the stacker, the feeder, the folder, the preparatory processor and the presser. The controller controls the preparatory processor not to process a sheet that will be an outermost sheet of a folded set of sheets.

18 Claims, 9 Drawing Sheets

SHEET POST-PROCESSING DEVICE WITH PERFORATOR AND METHOD FOR MAKING A FOLDED SET OF SHEETS

This application is based on Japanese patent application No. 2009-146183 filed on Jun. 19, 2009, of which content is incorporated herein by reference.

BACKGROUND OF THE INVENTION

1. Field of the Invention

The present invention relates to a sheet post-processing device, and more particularly to a sheet post-processing device for finishing, for example, binding or stapling sheets ejected from an image forming apparatus such as an electrophotographic copying machine.

2. Description of Related Art

It is known that sheets ejected from an image forming apparatus such as an electrophotographic copying machine are bound into a booklet. Japanese Patent Laid-Open Publication No. 2004-284750 and Japanese Patent Laid-Open Publication No. 2008-214104 suggest that preparatory to folding of a set of sheets, perforations or a fold be made in every sheet.

However, making perforations in every sheet is not good in appearance because the perforations made in the outermost sheet of a booklet are apparent.

SUMMARY OF THE INVENTION

According to a first aspect of the present invention, a sheet post-processing device comprises: a stacker for stacking and storing sheets therein; a feeder for receiving sheets and feeding the sheets toward the stacker; a folder for folding a set of sheets stored in the stacker; a preparatory processor, which is located upstream from the folder, for processing sheets preparatory to folding of a set of sheets; a presser for pressing the set of sheets stored in the stacker at a portion processed by the preparatory processor so as to push the set of sheets into the folder; and a controller for controlling the stacker, the feeder, the folder, the preparatory processor and the presser, and in the post-processing device, the controller controls the preparatory processor not to process a sheet that will be an outermost sheet of a folded set of sheets.

According to a second aspect of the present invention, a method for making a folded set of sheets comprising: a storing step of storing and stacking sheets; a feeding step of receiving sheets and feeding the sheets toward the stacker; a pre-processing step of processing sheets preparatory to folding of a set of sheets, a sheet that will be an outermost sheet of a folded set of sheets not processed at the pre-processing step; and a folding step of folding a set of sheets by pressing the set of sheets at the portion processed at the pre-processing step.

BRIEF DESCRIPTION OF THE DRAWINGS

These and other features of the present invention will be apparent from the following description with reference to the accompanying drawings, in which.

DETAILED DESCRIPTION OF THE PREFERRED EMBODIMENTS

Figure 1:
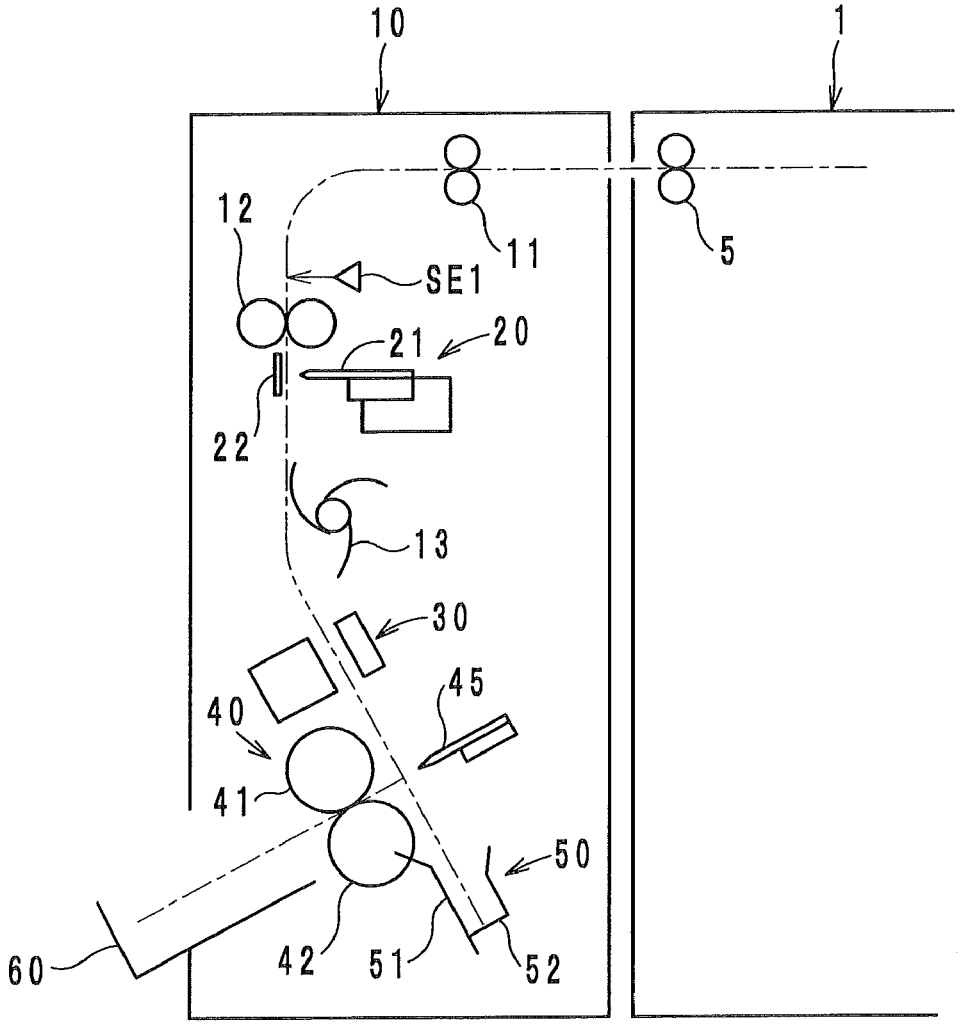
FIG. 1 is a schematic view of a sheet post-processing device according to an embodiment of the present invention.

A sheet post-processing device according to an embodiment of the present invention will be hereinafter described with reference to the accompanying drawings. In the drawings, the same parts and the same members are provided with the same reference symbols, and repetitious descriptions are omitted.

In FIG. 1, the number 1 denotes an electrophotographic copying machine, and the number 10 denotes a post-processing device, which is generally called a finisher. The copying machine 1 is of a conventional type, and a printed sheet is ejected from the copying machine 1 through rollers 5. In FIG. 1, the dashed line shows a sheet path.

The post-processing device 10 comprises a folder (composed of folding rollers 41 and 42) and a preparatory processor located upstream from the folder 40, a stacker 5 for stacking sheets therein, a presser 45 for pressing a sheet stack stored in the stacker 5 at the portion processed by the preparatory processor so as to push the sheet stack into the nip portion between the rollers 41 and 42, and a stapler 30. Specifically, the preparatory processor is a perforator 20 for making perforations in a sheet. The sheet post-processing device 10 further comprises rollers 11 for receiving a sheet from the copying machine 1, feed rollers 12, a sheet sensor SE1, a paddle wheel 13 for providing the sheet with force to travel, and a sheet tray 60.

In the sheet post-processing device 10, sheets ejected from the copying machine 1 are perforated by the perforator 20 one by one so that each sheet will have perforations in the center with respect to a sheet traveling direction, the perforations extending in a direction perpendicular to the sheet traveling direction. Then, the perforated sheets are stacked in the stacker 50. When a specified number of sheets are stacked in the stacker 50, the stacker 50 moves up until the perforations made in the sheets stored in the stacker 50 come to a stapling point of the stapler 30. Then, the stapler 30 staples the sheets in the center with respect to the sheet traveling direction. Thereafter, the stacker 50 moves down until the stapled portion of the sheet stack comes opposite the nip portion between the rollers 41 and 42, and the presser 45 presses the stapled set of sheets into the nip portion between the rollers 41 and 42. Thereby, the stapled set of sheets is folded in two at the center with respect to the sheet traveling direction and is ejected onto the sheet tray 60.

Figure 7:
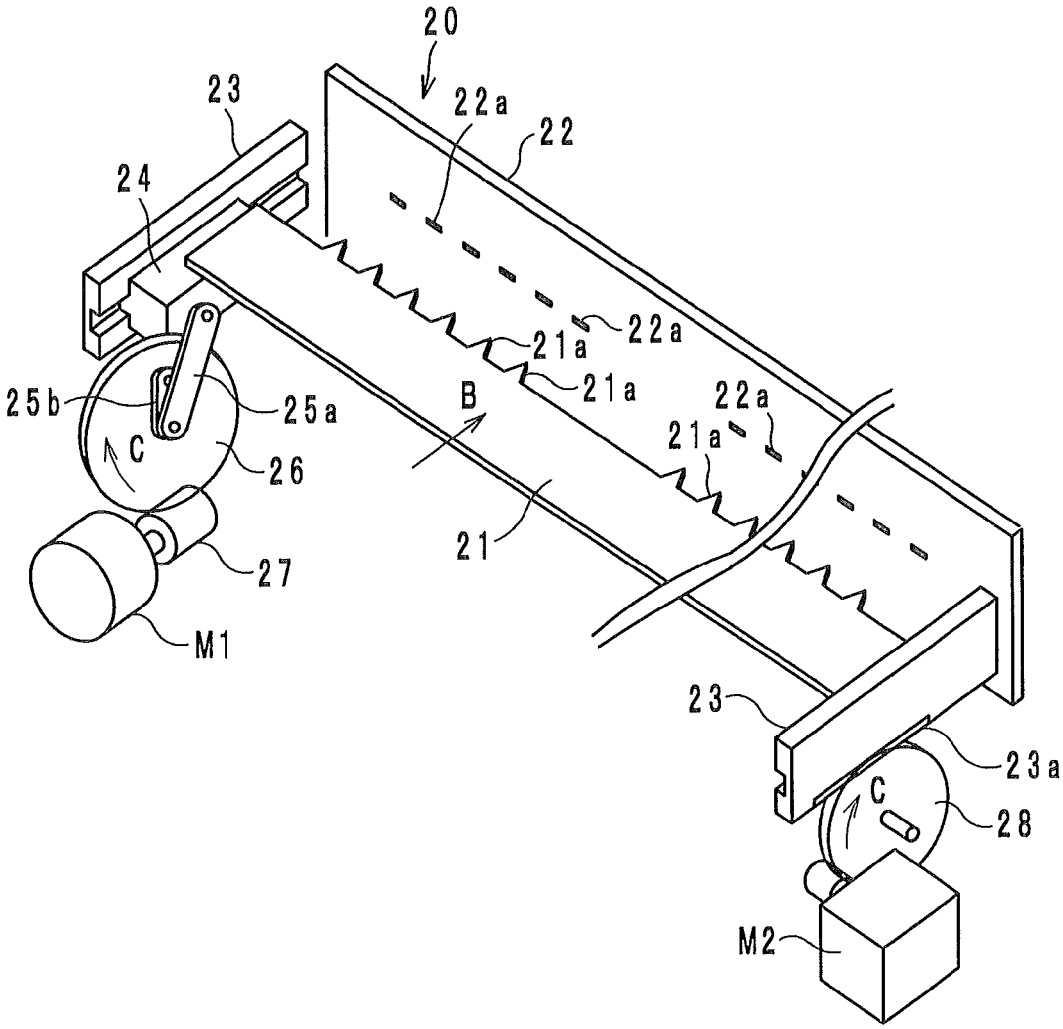
FIG. 7 is a perspective view of the perforator.

As shown by FIG. 7, the perforator 20 comprises a blade 21 having teeth 21*a* and a rear plate 22 having holes 22*a*. The blade 21 is laid between rails 23 via blocks 24 such that the blade 21 is movable in a direction "B" along the rails 23 together with the blocks 24. One of the blocks 24 is eccentrically connected to a gear 26 via links 25*a* and 25*b*, and the gear 26 engages with a warm gear 27 that is driven to rotate forward and backward by a motor M1. Accordingly, when the gear 26 is driven to rotate forward (in a direction "C"), the blade 21 moves in the direction "B" along the rails 23. At this time, the blade 21 makes perforations in a sheet such that the perforations extend in the direction perpendicular to the sheet traveling direction. When the gear 26 is driven to rotate backward, the blade 21 returns to the initial position.

The rails 23 at both sides are connected to each other by a connector (not shown). A rack 23*a* of one of the rails 23 engages with a gear 28 that is driven to rotate forward and backward by a motor M2. When the gear 28 is driven to rotate forward (in a direction "C"), the rails 23 and the blade 21 move in the direction "B", and when the gear 28 is driven to rotate backward, the rails 23 and the blade 21 move in the opposite direction to the direction "B". Thus, by rotating the motor M2 forward and backward, the initial position of the blade 21 can be adjusted. This adjustment is to make perforations with a length appropriate to the thickness of a sheet.

The stapler 30 is of a conventional type that sticks a staple into a sheet stack in response to a drive signal, and the stapler 30 is driven by a motor (not shown). The presser 45 pushes a sheet stack stored in the stacker 50 at the center portion with respect to the sheet traveling direction into the nip portion of the folding rollers 41 and 42. The stacker 50 is composed of a rear plate 51 and a bottom plate 52, and the bottom plate 52 is driven by a motor (not shown) to move up and down along the rear plate 51.

Figure 2:
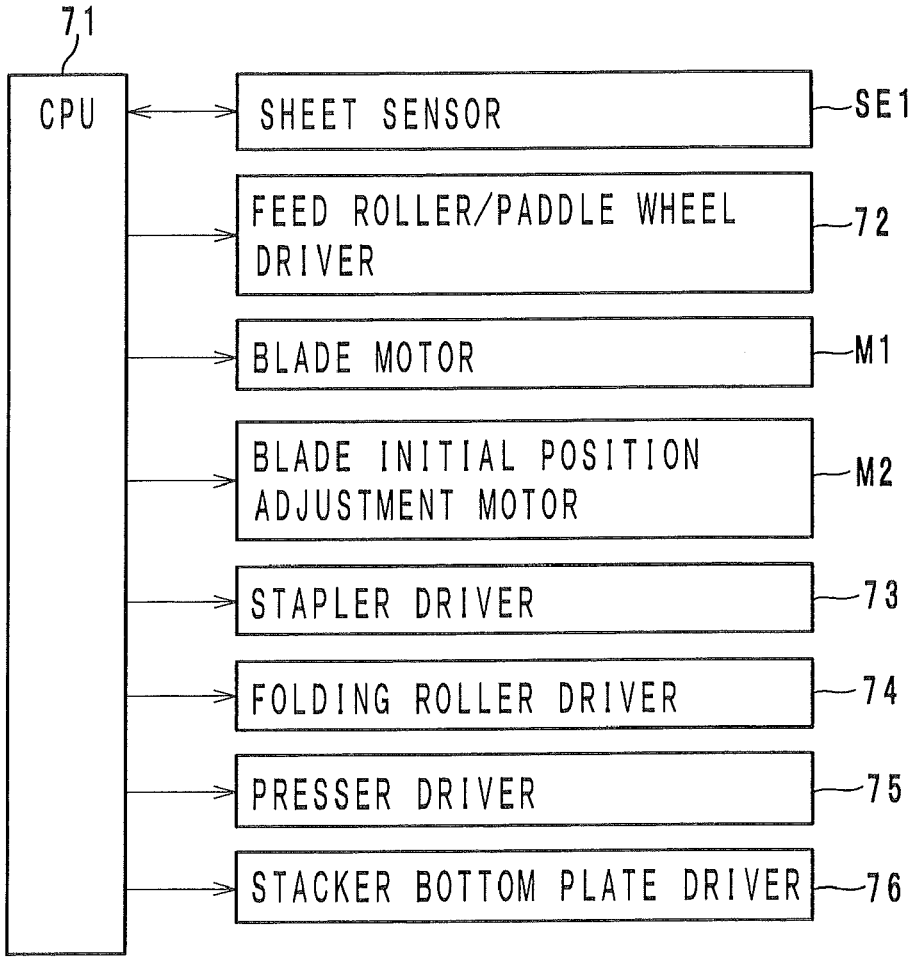
FIG. 2 is a block diagram of a control unit of the sheet post-processing device.

Now, referring to FIG. 2, a control unit of the sheet post-processing device 10 is described. The main component of the control unit is a CPU 71, and the CPU 71 receives a detection signal from the sheet sensor SM. The CPU 71 controls various drivers, namely, a feed roller/paddle wheel driver 72, the blade motor M1, the blade initial position adjustment motor M2, a stapler driver 73, a folding roller driver 74, a presser driver 75 and a stacker bottom plate driver 76. This control unit is to control the sheet post-processing device 10 wholly. However, FIG. 2 shows only the essential part thereof.

Figure 3A:
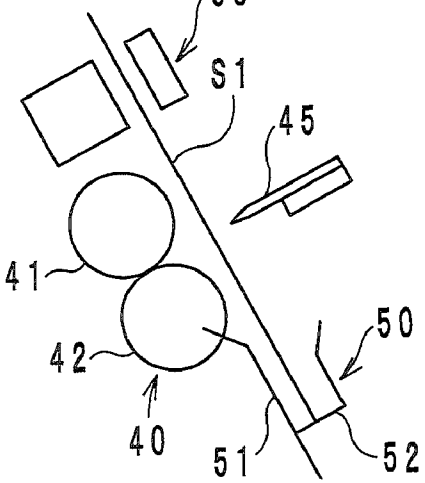
FIGS. 3*a* to 3*c* are illustrations showing a process of folding a sheet.
Figure 3B:
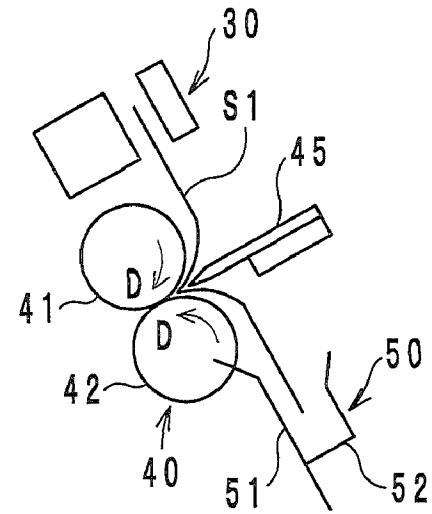
Figure 3C:
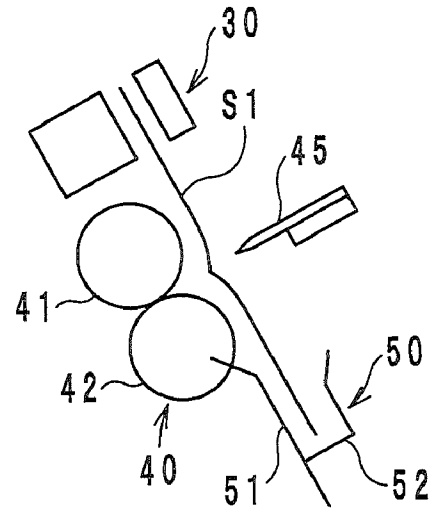

The following describes how a sheet ejected from the copying machine 1 is processed. When a first sheet S1 (which will be the outermost sheet of a booklet) is fed into the post-processing device 10, the sheet is fed further by the rollers 11, 12 and the paddle wheels 13, passes by the perforator 20 and the stapler 30 and is stored in the stacker 50 (see FIG. 3*a*). By that time, the level of the bottom plate 52 was adjusted such that the center of the sheet S1 with respect to the sheet traveling direction would be on a level with the nip portion between the folding rollers 41 and 42. The sheet S1 is pressed by the presser 45 into the nip portion of the rollers 41 and 42, and concurrently, the rollers 41 and 42 are slightly rotated forward (in a direction "D"), so that the sheet S1 obtains a fold (see FIG. 3*b*). Thereafter, the rollers 41 and 42 are rotated backward, whereby the sheet S1 is returned to the stacker 50 (see FIG. 3*c*).

Figure 4:
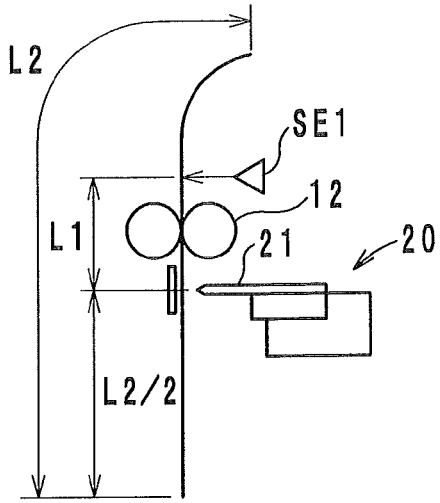
FIG. 4 is an illustration showing a state where a sheet is passing through a perforator.

Subsequently, when a second sheet S2 is fed into the post-processing device 10, the perforator 20 operates to make perforations in the sheet S2 at a portion corresponding to the fold of the first sheet S1, that is, the center portion with respect to the sheet traveling direction. In this moment, the sheet S2 is stopped once so as to be processed by the perforator 20, and the time to stop the sheet S2 is determined based on the detection by the sensor SE1. FIG. 4 shows the positional relationship between the blade 21 of the perforator 20 and the sensor SE1.

Referring to FIG. 4, the distance between the detection point of the sensor SE1 and the perforation point of the blade 21 is L1, and the dimension of the sheet S2 in the sheet traveling direction is L2. After the sensor SE1 detects the leading edge of the sheet S2, the sheet S2 is fed forward by the feed rollers 12 by a distance of L1+(L2/2) from the detection point, and then, the sheet S2 is stopped once. Here, the blade 21 is driven to make perforations in the sheet S2.

Figure 5A:
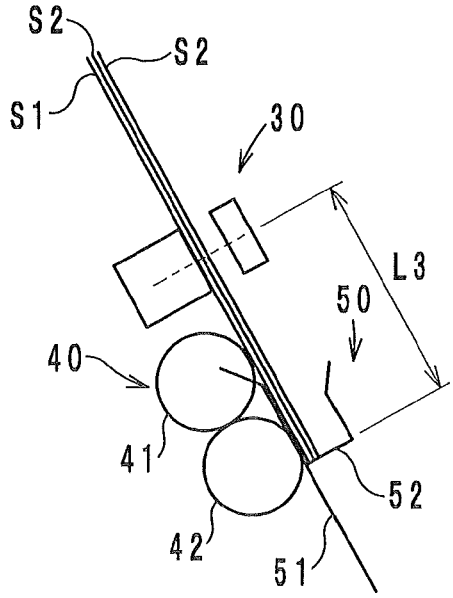
FIGS. 5*a* and 5*b* are illustrations showing a process of stapling sheets.

After obtaining the perforations, the sheet S2 is fed downward by the feed rollers 12 and the paddle wheel 13 and is stored in the stacker 50 (see FIG. 5*a*). By this moment, the level of the bottom plate 52 of the stacker 50 was adjusted such that the distance L3 between the stapling point of the stapler 30 and the bottom plate 52 would be equal to L2/2. The subsequent sheets, from a third to a second last, are processed by the perforator 20 and are stored in the stacker 50 in the same way.

Figure 5B:
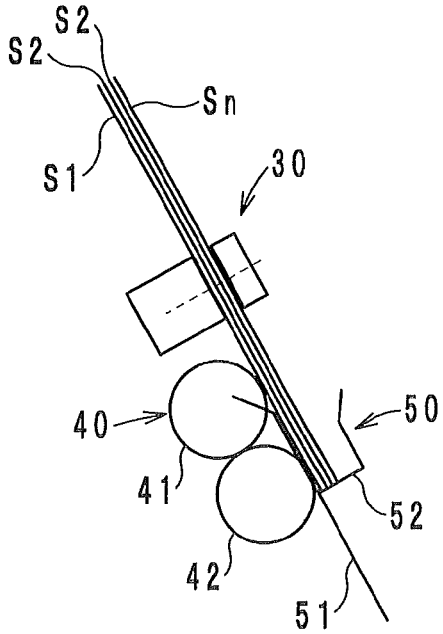

The last sheet Sn is, like the first sheet S1, fed into the stacker 50 without being processed by the perforator 20. Thereafter, all the sheets S1, S2, . . . and Sn stored in the stacker 50 are stapled by the stapler 30 (see FIG. 5*b*). In the stacker 50, sheets are stacked sequentially from left to right in the drawings.

Figure 6A:
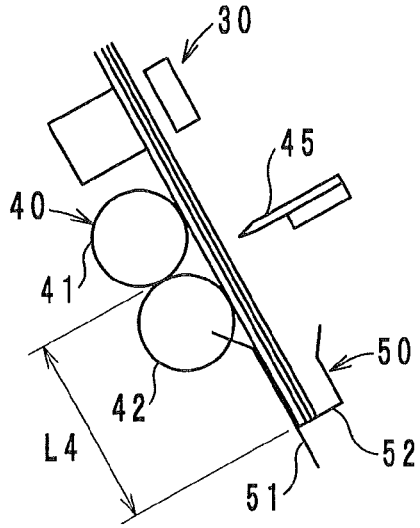
FIGS. 6*a* to 6*c* are illustrations showing a process of folding a set of sheets.
Figure 6B:
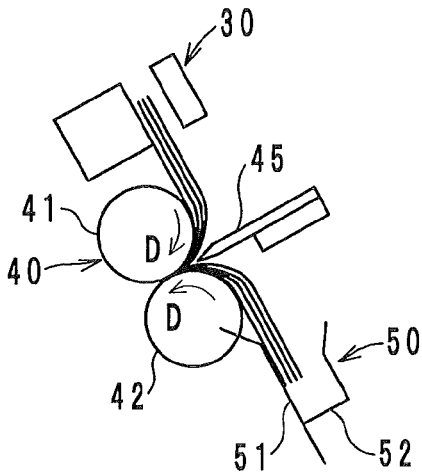
Figure 6C:
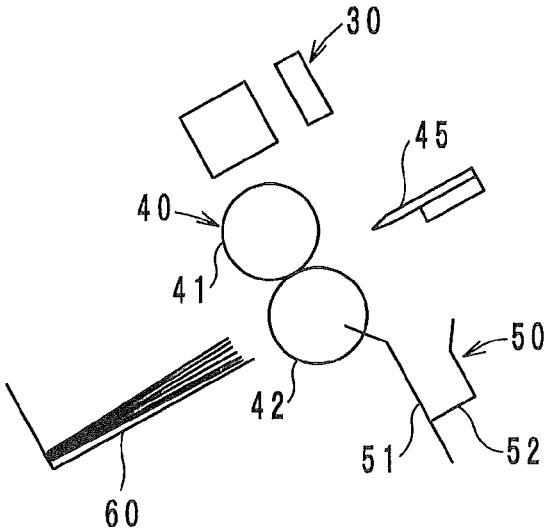

Next, the bottom plate 52 of the stacker 50 moves down by a specified amount (see FIG. 6*a*). Specifically, the bottom plate 52 moves down until the distance L4 between the nip portion between the rollers 41 and 42 and the bottom plate 52 becomes equal to L2/2. Then, the presser 45 is driven to push the stapled set of sheets into the nip portion between the rollers 41 and 42, and concurrently, the rollers 41 and 42 are rotated forward (see FIG. 6*b*). Thereby, the stapled set of sheets is folded up at the center and is ejected from the rollers 41 and 42 to the tray 60 (see FIG. 6*c*).

Figure 8A:
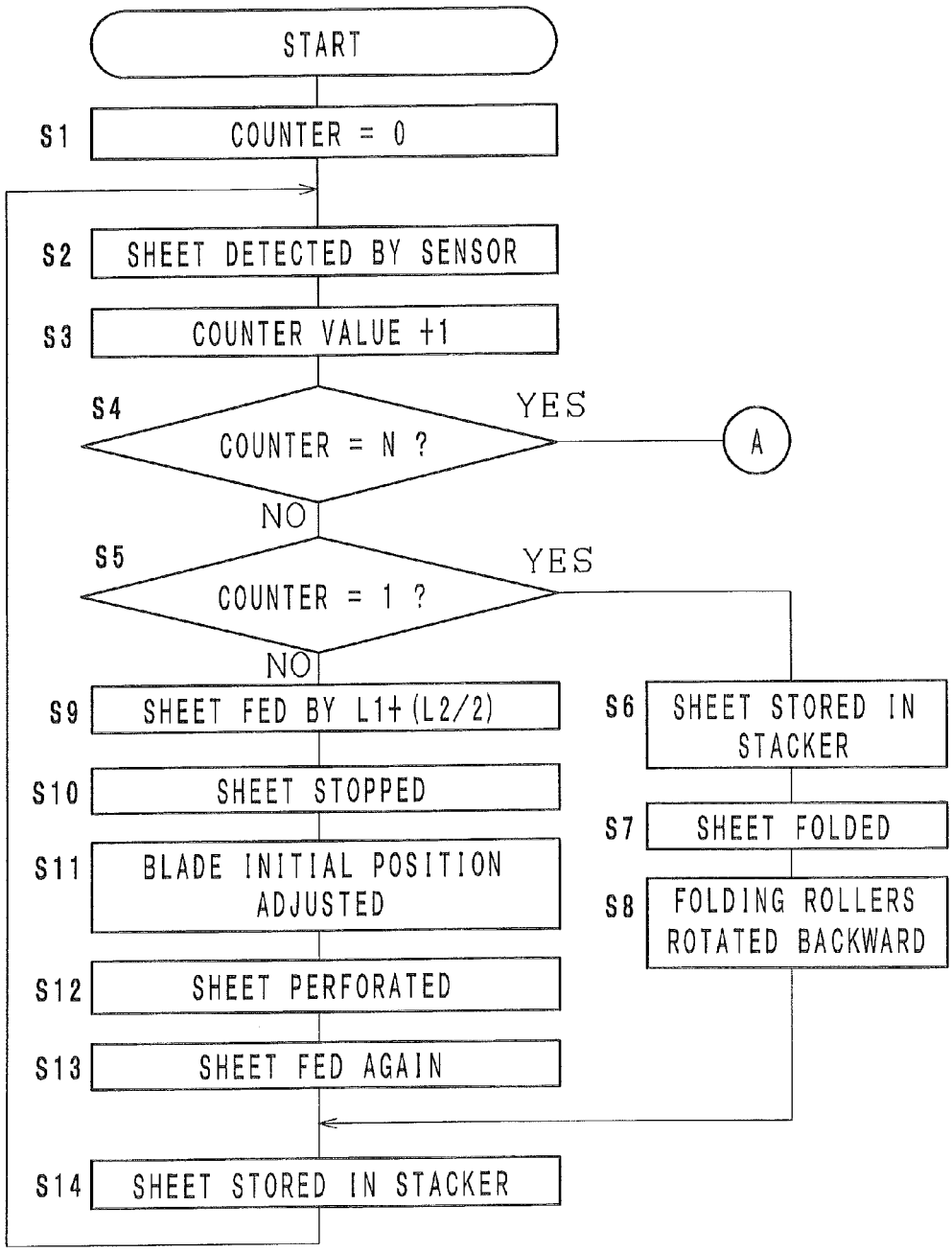
FIGS. 8*a* and 8*b* are flowcharts showing a procedure.
Figure 8B:
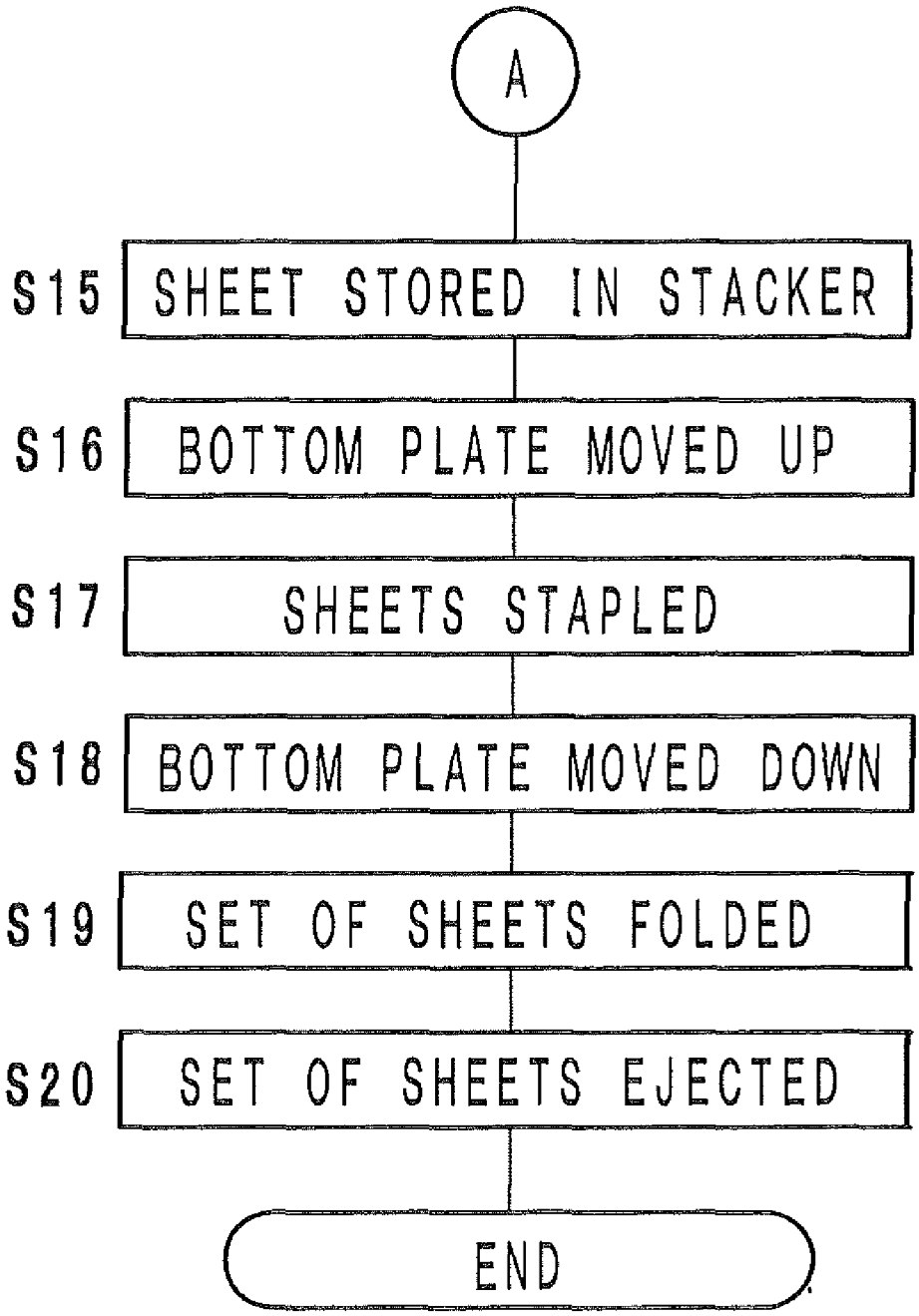

Now, referring to FIGS. 8*a* and 8*b*, a control procedure for the operation above is described. First, a counter for counting fed sheets is set to zero (step S1). When the leading edge of a sheet is detected by the sensor SE1 (step S2), one is added to the counter value (step S3). When the counter value is not N, which is the number of sheets to be stapled ("NO" at step S4), and is one ("YES" at step S5), this means that the first sheet S1 enters into the post-processing device 10. Therefore, the first sheet S1 is fed into the stacker 50 without being perforated (step S6). Then, a fold is made in the sheet S1 (step S7), and the folding rollers 41 and 42 are rotated backward (step S8) to return the sheet S1 into the stacker 50 (step S14).

When the counter value is neither N nor one ("NO" at steps S4 and S5), this means that any of the second sheet S2 to the second last sheet Sn-1 enters into the post-processing device 10. Therefore, the sheet is fed further by a distance of L1+(L2/2) from the detection point of the sensor SE1 (step S9) and is stopped once (step S10). Next, if necessary, the motor M2 is rotated to adjust the initial position of the blade 21 (step S11), and the blade 21 is driven to make perforations (step S12). Thereafter, the sheet is fed downward (step S13) and is stored in the stacker 50 (step S14).

When the counter value is N ("YES" at step S4), this means that the last sheet Sn enters into the post-processing device 10. The sheet Sn is stored in the stacker 50 without being perforated (step S15). Thereafter, the bottom plate 52 of the stacker 50 is moved up (step S16), and the sheets stacked in the stacker 50 are stapled by the stapler 30 (step S17). Thereafter, the bottom plate 52 is moved down (step S18), and the stapled set of sheets is folded by the folding rollers 41 and 42 (step S19). In this way, the sheets are made into a booklet and ejected to the tray 60 (step S20).

Figure 9:
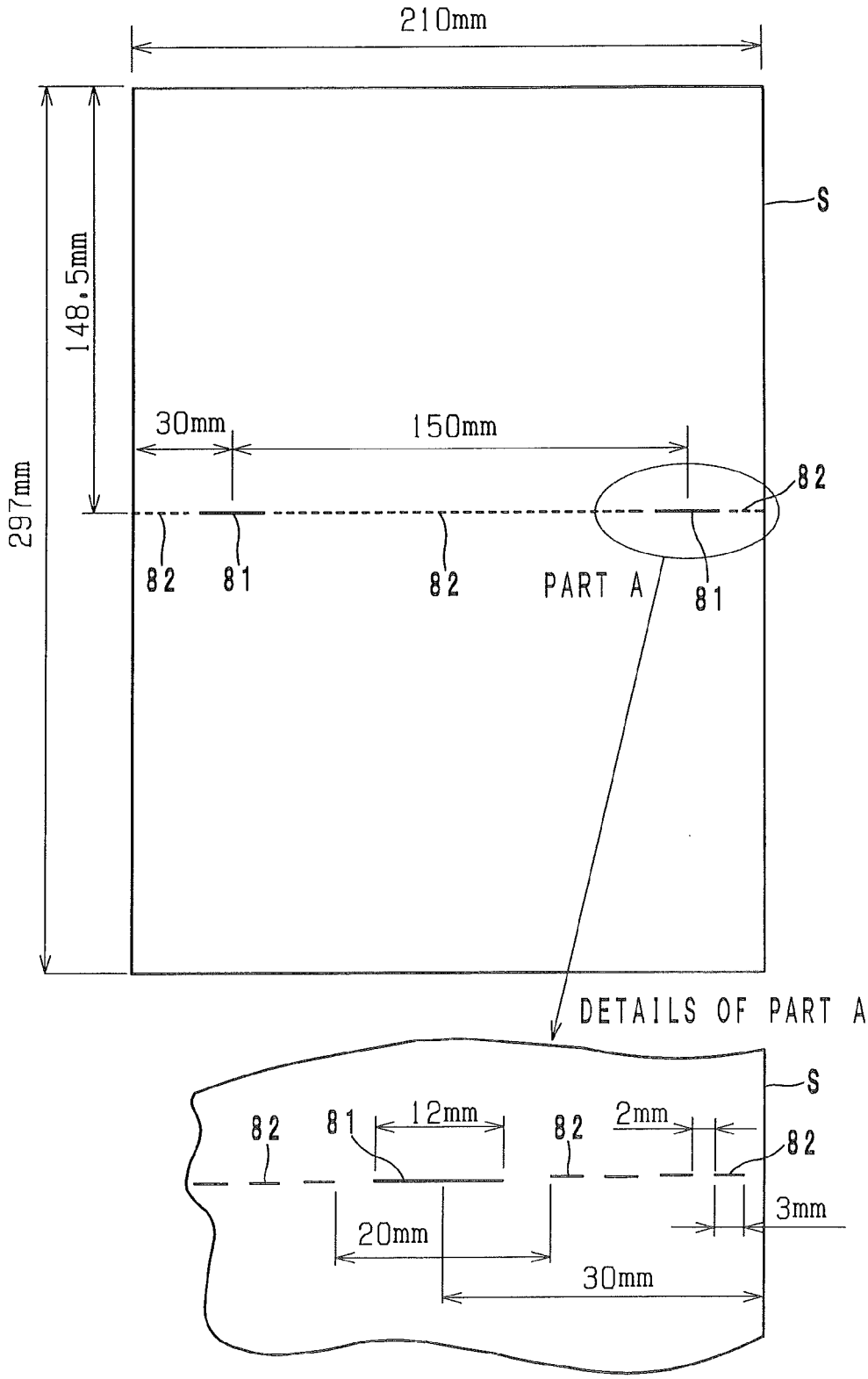
FIG. 9 is an illustration showing a perforated portion and a stapled portion.

Now, referring to a specific example of FIG. 9, the perforated portion and the stapled portion of sheets are described. When A4-sized sheets S are fed with their longer sides parallel to the sheet traveling direction, the dimension of each sheet S in the sheet traveling direction is 297 mm, and the dimension of each sheet S in the direction perpendicular to the sheet traveling direction is 210 mm. The distance from an edge to the center of each sheet S with respect to the sheet traveling direction is 148.5 mm. In this case, staples 81 are hit in the sheets S at points that are respectively 30 mm inward from both sides. The length of the staples 81 is 12 mm. The sheets S are stapled and perforated at the center with respect to the sheet traveling direction. However, perforations 82 are not made in the parts where the staples 81 are stuck. More specifically, within a length of 20 mm around a stapled point (a staple length of 12 mm plus right and left margins), perforations 82 are not made. Perforations 82, each of which has a length of 3 mm, are made at intervals of 2 mm.

As described above, in the sheet post-processing device 10, the second sheet S2 to the second last sheet Sn-1 are perforated preparatory to the folding of a sheet stack, and thereby, the folding of a sheet stack becomes easy. On the other hand, the first sheet S1, which will be the outermost sheet of a booklet, is not perforated, and therefore, the booklet has perforations only in the inner part that is not visible from outside. That is, the perforations will not mar the appearance of the booklet. The last sheet Sn is not perforated, and when the booklet is opened, the perforations are not visible. Further, because a fold is made in the first sheet S1 preparatory to the folding of a sheet stack, even the outermost sheet of a stack can be folded securely.

The total length of the perforations made in a sheet by the perforator 20 is preferably equal to or less than ⅔ of the dimension of the sheet in the direction perpendicular to the sheet traveling direction. This is to prevent the sheet from being torn at the folded portion. Since the perforator 20 comprises an adjuster (the motor M2 and the gear 28) for adjusting the initial position of the blade 21, perforations with a length appropriate to the thickness of the sheet can be made. For example, long perforations are made in thick sheets so that the thick sheets will fold easily, and short perforations are made in thin sheets so that the thin sheets will be prevented from being torn. Further, the teeth 21*a* of the blade 21 are arranged so as not to make perforations in sheets in the parts where the stapler 30 will stick staples. Therefore, it never happens that a stapled booklet will be torn at the perforations stuck by staples.

In subjecting a sheet to the perforation, the sheet is fed downward from the detection point of the sensor SE1 by a distance of L1+(L2/2) and is stopped once. There, the sheet is perforated, and the sheet is fed again. With this arrangement, perforations are made in every sheet precisely at the center with respect to the sheet traveling direction. The distance between the perforating point of the perforator 20 and the stapling point of the stapler 30 is preferably greater than a half of the maximum sheet size in the sheet traveling direction that can be handled in the sheet post-processing device 10. With this arrangement, it is prevented that the leading edge of a sheet that is being perforated touches the trailing edge of a sheet that is stored in the stacker 50.

The sheet post-processing device according to the embodiment above has been proposed so as to make a neat booklet while facilitating folding of a stack of sheets. Specifically, in the sheet post-processing device according to the embodiment, preparatory to folding of a set of sheets, sheets are processed by the preparatory processor. However, a sheet that will be the outermost sheet of a folded set of sheets is not processed by the preparatory processor. Therefore, when the sheets are bound into a booklet, the portion processed by the preparatory processor is invisible from outside.

Moreover, the preparatory processor may be further controlled not to process a sheet that will be the innermost sheet of a booklet. In this case, the portion processed by the preparatory processor will be invisible even when the booklet is opened.

Thus, in the sheet post-processing device according to the embodiment, sheets are subjected to a preparatory process before the sheets are bound into a booklet, but a sheet that will be the outermost sheet of the booklet is not subjected to the preparatory process. Therefore, a neat booklet can be made.

In the embodiment above, before a sheet stack is folded, the first-fed sheet, which will be the outermost sheet of a booklet, is folded. However, this process is not indispensable. Also, although the last-fed sheet, which will be the innermost sheet of a booklet, is not perforated in the embodiment above, the last-fed sheet may be perforated.

The perforator, the folder, the stapler and the stacker may be structured arbitrarily.

Although the present invention has been described in connection with the preferred embodiments above, it is to be noted that various changes and modifications are possible to those who are skilled in the art. Such changes and modifications are to be understood as being within the scope of the invention.

What is claimed is:

1. A sheet post-processing device comprising:

a stacker for stacking and storing sheets therein;

a feeder for receiving the sheets and feeding the sheets toward the stacker;

a folder for folding the sheets stored in the stacker to make a folded set of sheets;

a preparatory processor, which is located upstream from the folder, for processing the sheets before folding the sheets;

a presser for pressing the sheets stored in the stacker at a portion processed by the preparatory processor so as to push the sheets into the folder; and a controller for controlling the stacker, the feeder, the folder, the preparatory processor and the presser;

wherein the controller controls the preparatory processor not to process a sheet that will be an outermost sheet of the folded set of sheets;

wherein the preparatory processor is a perforator for making perforations in a sheet with a blade having teeth, the perforations extending in a direction perpendicular to a sheet traveling direction; and wherein the controller controls the folder to make a fold in the sheet that will be the outermost sheet of the folded set of sheets before other sheets, that will be part of the folded set of sheets, are stored in the stacker.

2. A sheet post-processing device according to claim 1, wherein the controller controls the preparatory processor not to process a sheet that will be an innermost sheet of the folded set of sheets.

3. A sheet post-processing device according to claim 1, wherein the perforations made in a sheet by the perforator have a total length that is equal to or less than ⅔ of a dimension of the sheet in the direction perpendicular to the sheet traveling direction.

4. A sheet post-processing device according to claim 1, wherein the perforator comprises a driving mechanism for moving the blade to and from a sheet and an adjusting mechanism for adjusting an initial position of the blade.

5. A sheet post-processing device according to claim 1, wherein the controller controls the folder so that only a portion of the sheet that will be the outermost sheet of the folded set of sheets passes through the folder when the folder is controlled to make a fold in the sheet that will be the outermost sheet of the folded set of sheets.

6. A sheet post-processing device according to claim 1, wherein the controller controls the folder so that the sheet that will be the outermost sheet of the folded set of sheets passes through the folder a second time when the other sheets that will be part of the folded set of sheets are folded by the folder.

7. A sheet post-processing device comprising:

a stacker for stacking and storing sheets therein;

a feeder for receiving sheets and feeding the sheets toward the stacker;

a folder for folding a set of sheets stored in the stacker;

a preparatory processor, which is located upstream from the folder, for processing sheets preparatory to folding of a set of sheets;

a presser for pressing the set of sheets stored in the stacker at a portion processed by the preparatory processor so as to push the set of sheets into the folder;

a controller for controlling the stacker, the feeder, the folder, the preparatory processor and the presser;

wherein the controller controls the preparatory processor not to process a sheet that will be an outermost sheet of a folded set of sheets;

wherein the preparatory processor is a perforator for making perforations in a sheet with a blade having teeth, the perforations extending in a direction perpendicular to a sheet traveling direction;

a stapler for stapling sheets;

wherein the stapler sticks a staple into the set of sheets stored in the stacker along the perforations made by the perforator; and wherein the teeth of the blade are arranged not to make perforations in a part where the stapler is to stick a staple.

8. A sheet post-processing device according to claim 7, wherein a distance between a perforation point of the perforator and a stapling point of the stapler is greater than a half of a sheet size in the sheet traveling direction.

9. A sheet post-processing device comprising:

a stacker for stacking and storing sheets therein;

a feeder for receiving sheets and feeding the sheets toward the stacker;

a folder for folding a set of sheets stored in the stacker;

a preparatory processor, which is located upstream from the folder, for processing sheets preparatory to folding of a set of sheets;

a presser for pressing the set of sheets stored in the stacker at a portion processed by the preparatory processor so as to push the set of sheets into the folder:

a controller for controlling the stacker, the feeder, the folder, the preparatory processor and the presser;

wherein the controller controls the preparatory processor not to process a sheet that will be an outermost sheet of a folded set of sheets;

wherein the preparatory processor is a perforator for making perforations in a sheet with a blade having teeth, the perforations extending in a direction perpendicular to a sheet traveling direction;

a detector, which is located upstream from the perforator, for detecting a sheet; and wherein the controller controls the feeder to feed a sheet from a detection point of the detector by a distance of $L1+(L2/2)$ and to stop the sheet once, controls the perforator to make perforations in the sheet, and thereafter controls the feeder to start feeding the sheet again, where $L1$ is a distance between the detection point of the detector and a perforation point of the perforator, and $L2$ is a dimension of the sheet in the sheet traveling direction.

10. A method for making a folded set of sheets, said method comprising:

a storing step of storing and stacking sheets with a stacker;

a feeding step of receiving the sheets and feeding the sheets toward the stacker;

a pre-processing step of processing the sheets before folding the sheets to make the folded set of sheets, a sheet that will be an outermost sheet of the folded set of sheets not being processed at the pre-processing step;

wherein the pre-processing step is a perforating step of making perforations in each sheet with a blade having teeth, the perforations extending in a direction perpendicular to a sheet traveling direction;

a pre-folding step of making a fold in the sheet that will be the outermost sheet of the folded set of sheets before other sheets, that will be part of the folded set of sheets, are stored and stacked in the storing step;

a folding step of folding the sheets to make the folded set of sheets by pressing the sheets at the portion processed at the pre-processing step.

11. A method according to claim 10, wherein at the pre-processing step, further, a sheet that will be an innermost sheet of the folded set of sheets is not processed.

12. A method according to claim 10, wherein the perforations made in a sheet have a total length that is equal to or less than ⅔ of a dimension of the sheet in the direction perpendicular to the sheet traveling direction.

13. A method according to claim 10, wherein the perforating step comprises:

a sub-step of adjusting an initial position of the blade; and a sub-step of moving the blade from the initial position to a sheet and back to the initial position.

14. A method according to claim 10, wherein a distance between a perforation point where the perforating step is performed and a stapling point where the stapling step is performed is greater than a half of a sheet size in the sheet traveling direction.

15. A method according to claim 10, wherein only a portion of the sheet that will be the outermost sheet of the folded set of sheets passes through a folder in the pre-folding step.

16. A method according to claim 10, wherein the sheet that will be the outermost sheet of the folded set of sheets is folded in both the pre-folding step and the folding step.

17. A method comprising:

a storing step of storing and stacking sheets;

a feeding step of receiving sheets and feeding the sheets toward the stacker;

a pre-processing step of processing sheets preparatory to folding of a set of sheets, a sheet that will be an outermost sheet of a folded set of sheets not processed at the pre-processing step;

a folding step of folding a set of sheets by pressing the set of sheets at the portion processed at the pre-processing step;

wherein the pre-processing step is a perforating step of making perforations in each sheet with a blade having teeth, the perforations extending in a direction perpendicular to a sheet traveling direction;

a stapling step of stapling sheets;

wherein a staple is stuck into the stored set of sheets along the perforations made at the perforating step; and wherein the teeth of the blade are arranged not to make perforations in a part where a staple is to be stuck.

18. A method comprising:

a storing step of storing and stacking sheets;

a feeding step of receiving sheets and feeding the sheets toward the stacker;

a pre-processing step of processing sheets preparatory to folding of a set of sheets, a sheet that will be an outermost sheet of a folded set of sheets not processed at the pre-processing step;

a folding step of folding a set of sheets by pressing the set of sheets at the portion processed at the pre-processing step;

wherein the pre-processing step is a perforating step of making perforations in each sheet with a blade having teeth, the perforations extending in a direction perpendicular to a sheet traveling direction;

a detecting step of detecting a sheet before making perforations in the sheet; and wherein the sheet is fed from a detection point where the detecting step is performed by a distance of $L1+(L2/2)$ and is stopped once to be subjected to the perforating step, and thereafter the sheet is fed again, where $L1$ is a distance between the detection point and a perforation point where the perforating step is performed, and $L2$ is a dimension of the sheet in the sheet traveling direction.

* * * * *